United States Patent [19]

Hidle

[11] Patent Number: 4,575,890

[45] Date of Patent: Mar. 18, 1986

[54] LINT REMOVAL DEVICE

[75] Inventor: Jerry Hidle, Panama City, Fla.

[73] Assignee: Panhandle Industries, Inc., Panama City, Fla.

[21] Appl. No.: 617,529

[22] Filed: Jun. 5, 1984

[51] Int. Cl.[4] ..... A47L 25/00

[52] U.S. Cl. ..... 15/104 A; 15/230.11; 29/110.5; 51/361; 51/392; 242/67.3 R

[58] Field of Search ..... 29/110.5; 51/357, 361, 51/392; 15/104 A, 230.11, 231, 233; 242/54 R, 55, 67.3 R; 355/16

[56] References Cited

U.S. PATENT DOCUMENTS

| | | | |
|---|---|---|---|
| 2,387,758 | 10/1945 | Jaros | 242/55 |
| 3,421,170 | 1/1969 | Thomas | 15/230.11 |
| 3,883,921 | 5/1975 | Thettu | 15/104 A |
| 3,934,835 | 1/1976 | Maxwell | 242/67.3 R |
| 3,974,974 | 8/1976 | Nishikawa | 242/67.3 R |
| 4,076,183 | 2/1978 | Kingsley | 242/67.3 R |
| 4,076,410 | 2/1978 | Kono | 242/67.3 R |
| 4,102,570 | 7/1978 | Shimoda | 355/16 |
| 4,112,536 | 9/1978 | Carson | 15/231 |
| 4,149,796 | 4/1979 | Adachi | 355/16 |
| 4,231,652 | 11/1980 | Moser | 242/67.3 R |
| 4,239,375 | 12/1980 | Eisbein | 242/67.3 R |
| 4,391,014 | 7/1983 | Pitzen | 15/104 A |
| 4,422,201 | 12/1983 | McKay | 15/104 A |

*Primary Examiner*—Chris K. Moore

*Attorney, Agent, or Firm*—Watson, Cole, Grindle & Watson

[57] ABSTRACT

The present invention relates generally to lint removal devices and more particularly, to lint removal devices incorporating a supply of adhesive sheet material having a tacky surface and means to advance the sheet material to present an unused surface of the sheet material.

8 Claims, 7 Drawing Figures

LINT REMOVAL DEVICE

BACKGROUND OF THE INVENTION

Conventional lint removal devices generally comprise a cylindrical housing mounted for rotation on an axial shaft which serves as a handle for the device. Adhesive sheet material having at least one tacky surface is mounted about the exterior of the housing with the tacky surface exposed. In use, the cylinder of the device is rolled over a textile and the adhesive sheet material.

Various arrangements have been used in lint removal devices to provide a supply of fresh adhesive sheet material over the initial sheet material no longer sufficiently tacky to satisfactorily pick up lint. One common arrangement is to utilize a wound roll of adhesive sheet material, the used top layer of sheet material being unwound and discarded thereby exposing an unused layer of sheet material. A lint removal device of this type is disclosed in U.S. Pat. No. 3,421,170 to Thomas. Another arrangement used in lint removal devices is the use of adhesive sheet material formed into tubes which may be slipped on and off the cylindrical housing of the device. A further arrangement is to provide a supply of adhesive sheet material within the cylindrical housing and to feed the sheet material to the exterior through a longitudinal slot. A lint removal device of this type is disclosed in U.S. Pat. No. 2,592,969 to Stachowiak. In all these devices, it is necessary for the user to manually manipulate the adhesive sheet material and to dispose of the used sheet material.

While the above described lint removal devices function satisfactorily for their intended purpose, it would be advisable to provide a lint removal device in which the used adhesive sheet material could be replaced more easily and more conveniently.

SUMMARY OF THE INVENTION

Accordingly, it is therefore an object of the invention to provide a device adapted for the removal of lint which is capable of selectively advancing adhesive sheet material contained therein.

It is yet another object of the invention to provide a lint removal device which advances adhesive sheet material smoothly and easily and with a minimum amount of effort and without the necessity for the user to manually manipulate the adhesive sheet material.

It is a further object of the invention to provide a lint removal device which has relatively few moving parts and can be easily manufactured.

Briefly, the present invention in its broader aspects comprehends a device adapted for removal of lint from textiles comprising a handle having a shaft, a generally cylindrical housing mounted for axial rotation on the shaft, said housing having at least one longitudinal slot therein, two rollers adapted to hold wound adhesive sheet material mounted for rotation within the housing, the rollers positioned within the housing such that sheet material from one roller can extend through a slot in the housing, about the outer periphery of the housing, back through a slot in the housing and wound about the other roller, at least one of said rollers connected to advancing means located at least partially on the exterior of the housing, said advancing means capable of selectively causing a roller to rotate and advance sheet material.

Further objects, advantages and features of the present invention will become more fully apparent from a detailed consideration of the arrangement and construction of the constituent parts as set forth in the following description taken together with the accompanying drawings.

DETAILED DESCRIPTION OF THE PREFERRED EMBODIMENTS

Figure 1:
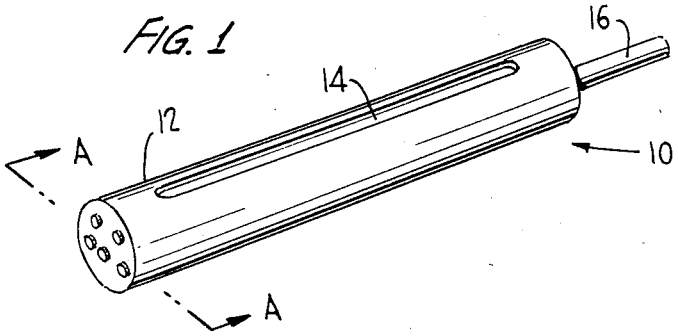
FIG. 1 is a perspective view of one embodiment of a device in accordance with the present invention.

Referring now to FIG. 1 of the drawings, shown is device 10 according the present invention which is adapted to remove lint from textile articles such as clothing, upholstery and the like. Device 10 comprises housing 12 of a hollow, generally cylindrical configuration having longitudinal slot 14. Extending axially from one end of housing 12 is rotatable handle 16. The periphery of housing 12 is adapted to support adhesive sheet material (not shown) which is sufficiently tacky to pick up lint from textile articles.

Figure 2:
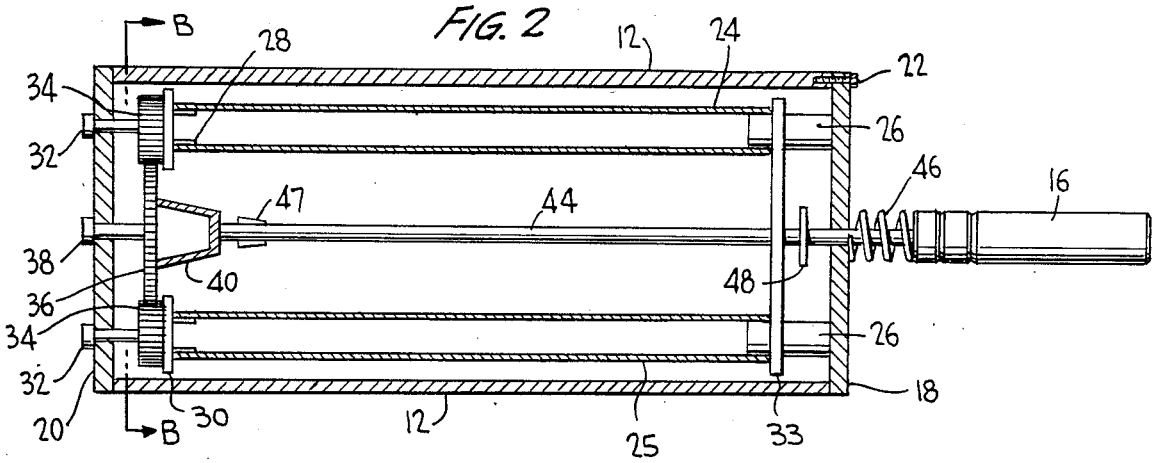
FIG. 2 is a cross-sectional view of the device of FIG. 1 taken along line A—A.

As is best shown in FIG. 2, a cross-sectional view taken along line A—A of FIG. 1, the open ends of housing 12 are closed by end plates 18 and 20, each plate secured to the housing by one or more locking pins 22. Located within housing 12 are two hollow rollers 24 and 25, each adapted to carry a wound roll of adhesive sheet material (not shown), one roller acting as supply roller for sheet material and the other acting as a take-up roller. Rollers 24 and 25 are mounted for rotation within housing 12 by rods 26 on end plate 18 projecting into the hollow end of each roller and by fingers 28 of locking washer 30 carried by shaft 32 which projects through end plate 20. Stop plate 33 tends to prevent significant axial movement of rollers 24 and 25 and stabilizes rods 26.

Figure 3:
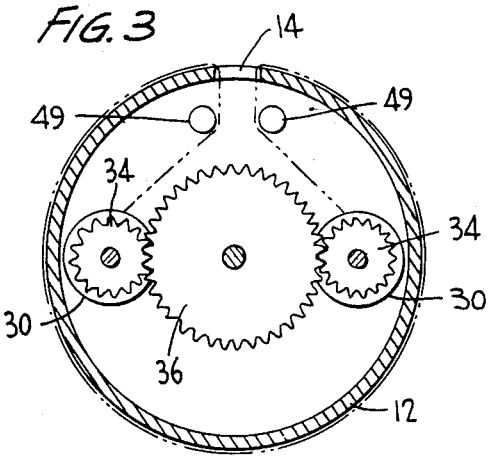
FIG. 3 is a cross-sectional view taken along line B—B of FIG. 2.
Figure 4:
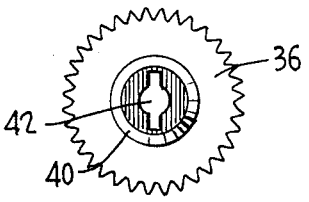
FIG. 4 is an end view of a coupler forming a part of the device of the present invention.

As is shown in FIGS. 2 and 3, each shaft 32 carries gear 34 which engages locking washer 30 and which also meshes with driving gear 36 on shaft 38 projecting through end plate 20. Attached to one side of driving gear 36 is hollow coupler 40 having slotted hole 42 therein as is best shown in FIG. 4. Hole 42 in coupler 40 receives and supports the end of handle shaft 44 which extends axially through housing 12, through a hole in end plate 18 and attaches into handle 16. Spring 46 biases handle shaft 44 such that blade-like projections 47 near the end of the shaft do not engage the slot in hole 42 of coupler 40. Locking nut 48 on handle shaft 44 acts as a stop to prevent spring 46 from forcing the handle shaft out of engagement with coupler 40. Thus, in this embodiment, handle 16, handle shaft 44, coupler 40 and gears 34 and 36 comprise advancing means capable of selectively causing a roller to rotate to thereby simultaneously advance and rewind adhesive sheet material.

In use, device 10 is loaded with a roll of adhesive sheet material having a tacky surface such that, as is shown in FIG. 3, the sheet material (shown in dotted lines) extends from one roller 24, over guide roller 49, through slot 14 and around the outer periphery of housing 12, and back through slot 14. The sheet then extends over second guide roller 49 and is taken up on second roller 25. Housing 12 of device 10 may then be rolled over a textile article to remove lint and the like, the user of the device holding onto handle 16. When the exposed portion of the adhesive sheet is no longer capable of removing lint, the user presses handle 16 inwardly so that projections 47 engage the slotted portion of hole 42 in coupler 40 and then by rotation of the handle, rollers 24 and 25 are caused to rotate so that an unused section of adhesive sheet material is exposed on the outer periphery of the housing 12. As a consequence, used sheet material is taken up by roller 25. Once the axial pressure on handle 16 is released, projections 47 disengage from coupler 40 and device 10 with a fresh portion of adhesive sheet material can be again used for the removal of lint. Preferably, driving gear 36 is of significantly larger diameter than gears 34 so that the exposure of a new portion of adhesive sheet material can be accomplished with a minimum number of rotations on handle 16.

Figure 5:
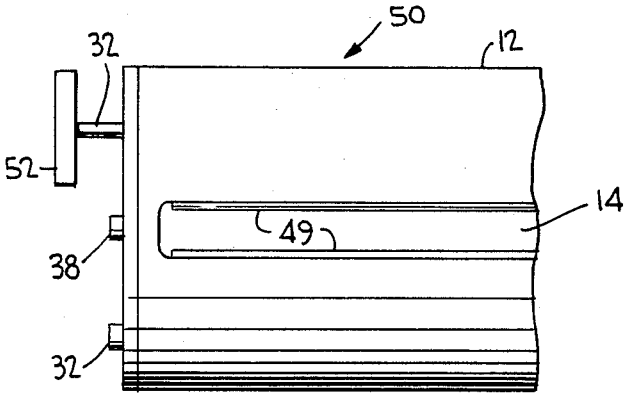
FIG. 5 is a partial top plan view of another embodiment of a device in accordance with the present invention.

FIG. 5 is a top plan view of another embodiment of a device according to the present invention. Device 50, like device 10 shown in FIGS. 1–4, contains rollers for unwinding and taking up adhesive sheet material, the rollers being driven by two gears with an intermediate meshing gear. In this embodiment, device 50 does not contain a handle shaft which can drive the gears, the gears being driven by rotation of key 52 fixedly attached to an extension of shaft 32. It should be recognized that key 52 could be attached to an extension of shaft 38 carrying the intermediate gear or to an extension of shaft 32 carrying the gear for the other roller instead of the shaft as is illustrated to provide advancing means for device 50.

In device 50, guide rollers 49 are positioned in a different location than in device 10. Guide rollers 49 are mounted for rotation within slot 14, the ends of each roller projecting into housing 12. This arrangement of guide rollers 49 facilitates assembly and disassembly of device 50 when replacing adhesive sheet material.

Figure 6:
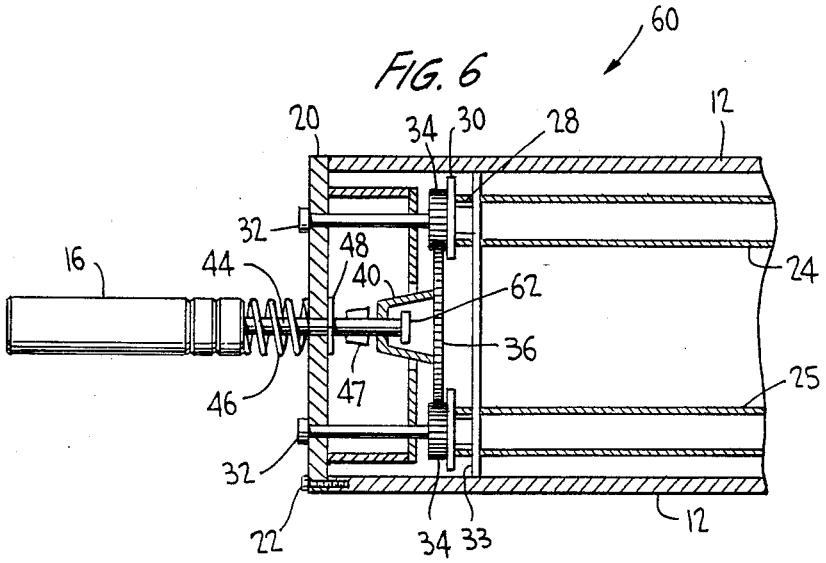
FIG. 6 is a partial cross-sectional view of yet another embodiment of a device according to the invention.

FIG. 6 illustrates another embodiment of a device according to the invention, the device being somewhat similar to device 10 shown in FIGS. 1–3 except that the advancing means comprising handle 16 has been repositioned to the other end of the device. Device 60 of this embodiment comprises hollow cylindrical housing 12 closed by end plate 20 which carries shafts 32. Rollers 24 and 25, adapted to carry wound adhesive sheet material, are mounted for rotation by fingers of locking washer which engages gear 34 on shaft 32. Rollers 24 and 25 pass through holes in support stop plate 33. Gear 36 having hollow coupler 40 affixed thereto meshes with gears 34. Handle shaft 44 with biasing spring 46 projects axially through a hole in end wall 20 and is received by an axial hole 42 in a hollow coupler 40. Locking nut 48 limits the outward movement of handle shaft 44 and stop 62 limits the movement of coupler 40 and gear 36 on the handle shaft. Blade-like projections 47 on handle shaft 44, upon inward axial pressure on handle 16, engages the slot in hole 42 of coupler 40 such that when the handle is rotated, gear 36 and ultimately rollers 22 and 24 are caused to turn and thereby advance adhesive sheet material.

Between gears 34 and 36 and stop plate 20 is cylindrical inner housing 62 having circular end plate 64 through which shafts 32 and coupler 40 project. Inner housing 62 and end plate 64 help keep driving gear 36 engaged with gears 34 and help stabilize handle 16.

An advantage of the embodiment of FIG. 6 is that once the supply of adhesive sheet material has been exhausted, end plate 20 with attached gears 34 and 36 can be removed from housing 12 and housing 12 with contained rollers 24 and 25 and used adhesive material can be discarded. Another housing 12 containing fresh adhesive sheet material could then be attached to end plate 20 thereby eliminating the task of threading sheet material from roller 24 to roller 25.

Figure 7:
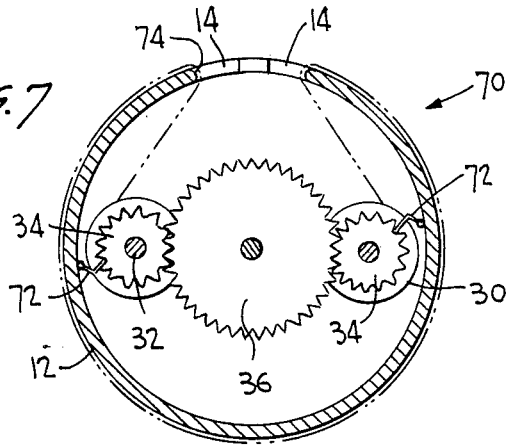
FIG. 7 is a cross-sectional view of another embodiment of a device according to the present invention.

FIG. 7 illustrates yet another embodiment of a device according to the invention which is a modification of device 10 shown in FIGS. 1–3. In device 70, only gear 34 associated with the take-up roller meshes with driving gear 36 while the other gear associated with feed roller 25 is able to rotate freely. Tension means 72 in the form of springs engaging the teeth of gears 34 are provided to assure that the adhesive sheet material remains under proper tension. By having only one gear 34 engage driving gear 36, device 70 is capable of compensating for the variation in size of the wound rolls of adhesive sheet material during use of the device.

Alternatively, driving gear 36 could be omitted from this embodiment and gear 34 associated with the take-up roller could be driven by other means such as a key attached to shaft 32 of gear 34 as was illustrated in FIG. 5.

Device 70 also includes two slots 14 in housing 12, one slot for the egress of fresh adhesive material from the housing and one for ingress of used adhesive sheet material. Smooth rounded edges 74 in housing 12 where the adhesive sheet material contacts the housing eliminate the need for guide rollers in device 70.

It should be understood that various alternative features of the invention have been illustrated in conjunction with certain other alternative features in the several embodiments and that the present invention is not thereby so limited. For example, device 10 of FIGS. 1–3 could incorporate either the slot mounted guide rollers of device 50 or the rounded edges of the housing defining the slots of device 60. In a similar manner, device 50 could utilize the gear mechanism of device 70. Thus while the invention has been described with reference to particular embodiments thereof, it will be understood that numerous modifications may be made without departing from the spirit and scope of the invention.

I claim:

1. A device adapted for removal of lint from textiles, comprising, a cylinder having at least one longitudinal slot in the wall thereof and having end walls, a coaxial shaft extending through one of said end walls for supporting said cylinder for rotation about the central axis of said shaft, a pair of spaced rolls lying parallel to and radially spaced from said shaft, said rolls extending between said end walls and being mounted thereon for rotation about the central axis of said shaft together with said cylinder, and said rolls being mounted on said end walls for rotation about the respective axes of said rolls, a web of material having a tacky, lint removable, outer surface being stored on one of said rolls, being taken-up on the other of said rolls, extending through said slot, and having a portion overlying said cylinder wall, one end of said shaft comprising a handle extending outwardly of said one end wall, whereby lint may be removed from textiles upon manually rolling said cylinder thereover, means rotatable about said central axis in rotary engagement with at least said other roll, said shaft being shiftable along said central axis thereof from an initial position to a second position, and means on said shaft selectively engageable with said rotatable means in said second position for selectively coupling said other roll with said shaft for rotation of said other roll about said roll axis thereof upon manual rotation of said shaft about said shaft axis, whereby said web is taken-up on said other roll for advancing another portion of said web from said one roll to overlie said cylinder wall.

2. The device according to claim 1, wherein said rotatable means comprises a drive gear, and a manually actuated coupler on said drive gear, a first driven gear in meshing engagement with said drive gear and being mounted on said other roll for rotation therewith about said axis thereof, and said means on said shaft being engageable with said coupler.

3. The device according to claim 2, further comprising a second driven gear in meshing engagement with said drive gear and being mounted on said one roll for rotation therewith about said roll axis thereof.

4. The device according to claim 2, wherein said shaft is movable along said axis thereof into and out of coupling rotary engagement with said coupler.

5. The device according to claim 4, wherein said shaft is spring biased out of said coupling rotary engagement.

6. The device according to claim 2, wherein at least one guide roller is located adjacent said longitudinal slot.

7. The device according to claim 2, wherein the surfaces of said slot are rounded.

8. The device according to claim 2, wherein means within said cylinder are provided for tensioning said web.

* * * * *